US007485010B2

(12) United States Patent
Aekins

(10) Patent No.: US 7,485,010 B2
(45) Date of Patent: Feb. 3, 2009

(54) MODULAR CONNECTOR EXHIBITING QUAD REACTANCE BALANCE FUNCTIONALITY

(75) Inventor: Robert A. Aekins, Quaker Hill, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 11/873,676

(22) Filed: Oct. 17, 2007

(65) Prior Publication Data

US 2008/0311797 A1 Dec. 18, 2008

Related U.S. Application Data

(63) Continuation-in-part of application No. 11/818,478, filed on Jun. 14, 2007.

(51) Int. Cl.
*H01R 24/00* (2006.01)

(52) U.S. Cl. ..... 439/676; 439/941; 439/620.17; 439/620.13

(58) Field of Classification Search ..... 439/676, 439/941, 620.17, 620.13, 620.11
See application file for complete search history.

(56) References Cited

U.S. PATENT DOCUMENTS

| | | | |
|---|---|---|---|
| 2,714,194 | A | 7/1955 | Beyniink |
| 5,186,647 | A | 2/1993 | Denkmann et al. |
| 5,269,708 | A | 12/1993 | DeYoung et al. |
| 5,299,956 | A | 4/1994 | Brownell et al. |
| 5,310,363 | A | 5/1994 | Brownell et al. |
| 5,326,284 | A | 7/1994 | Bohbot et al. |
| 5,341,419 | A | 8/1994 | Ferry |
| 5,350,324 | A | 9/1994 | Guilbert |
| 5,362,257 | A | 11/1994 | Neal et al. |
| 5,399,107 | A | 3/1995 | Gentry et al. |
| 5,414,393 | A | 5/1995 | Rose et al. |
| 5,432,484 | A | 7/1995 | Klas et al. |
| 5,513,065 | A | 4/1996 | Caveney et al. |
| 5,547,405 | A | 8/1996 | Pinney et al. |

(Continued)

FOREIGN PATENT DOCUMENTS

| | | |
|---|---|---|
| EP | 0 674 364 B1 | 9/1995 |

(Continued)

*Primary Examiner*—Gary F. Paumen
(74) *Attorney, Agent, or Firm*—McCarter & English, LLP

(57) ABSTRACT

Systems and methods are disclosed for interfacing with high frequency data transfer media and, more particularly, modular jack housing insert assemblies, such as those that are used as interface connectors for unshielded twisted pair ("UTP") media, that compensate for electrical noise. The insert generally includes (a) an insert housing member and (b) a plurality of lead frames supported at least in part by said insert housing member. Each of the lead frames generally includes a rear end portion and a front end portion. In addition, each of at least four of the plurality of lead frames typically includes a capacitive element in electrical communication with at least the front end portion of the respective lead frame. The four lead frames are in electrical communication with capacitive elements arranged in two pairs to define a first pair of capacitive element lead frames and a second pair of capacitive element lead frames. The first pair of capacitive element lead frames and the second pair of capacitive element lead frames are spaced apart by an angle of at least thirty degrees. Jack assemblies including the disclosed insert and associated methods for use thereof are also disclosed.

28 Claims, 7 Drawing Sheets

U.S. PATENT DOCUMENTS 5,586,914 A 12/1996 Foster, Jr. et al.
5,599,209 A 2/1997 Belopolsky
5,618,185 A 4/1997 Aekins
5,639,266 A 6/1997 Patel
5,647,770 A 7/1997 Belopolsky
5,674,093 A 10/1997 Vaden
5,687,478 A 11/1997 Belopolsky
5,697,817 A 12/1997 Bouchan et al.
5,759,070 A 6/1998 Belopolsky
5,779,503 A 7/1998 Tremblay et al.
5,864,089 A 1/1999 Rainal
5,911,602 A 6/1999 Vaden
5,913,702 A 6/1999 Garcin
5,931,703 A 8/1999 Aekins
5,938,479 A 8/1999 Paulson et al.
6,023,200 A 2/2000 Rhee
6,086,428 A 7/2000 Pharney et al.
6,089,923 A 7/2000 Phommachanh
6,113,418 A 9/2000 Kjeldahl
6,120,329 A 9/2000 Steinman
6,139,371 A 10/2000 Troutman
6,155,881 A 12/2000 Arnett et al.
6,162,076 A * 12/2000 Francaviglia ..... 439/188
6,162,077 A 12/2000 Laes
6,176,742 B1 1/2001 Arnett
6,183,306 B1 2/2001 Caveney
6,186,834 B1 2/2001 Arnett et al.
6,193,533 B1 2/2001 De Win
6,231,397 B1 5/2001 de la Borbolla et al.
6,290,546 B1 9/2001 Pharney
6,332,810 B1 12/2001 Bareel
6,346,010 B1 * 2/2002 Emplit ..... 439/620.17
6,361,354 B1 3/2002 Viklund et al.
6,409,547 B1 6/2002 Reede
6,443,777 B1 9/2002 McCurdy
6,520,806 B2 * 2/2003 Phommachanh ..... 439/676
6,572,414 B2 * 6/2003 Ahn et al. ..... 439/676
6,802,743 B2 * 10/2004 Aekins et al. ..... 439/676
6,840,816 B2 * 1/2005 Aekins ..... 439/676
6,896,557 B2 5/2005 Aekins
7,037,140 B2 * 5/2006 Aekins et al. ..... 439/676
2002/0081908 A1 * 6/2002 Ahn et al. ..... 439/676
2002/0160663 A1 * 10/2002 Gutierrez et al. ..... 439/676

FOREIGN PATENT DOCUMENTS

EP 0 955 703 A2 11/1999
EP 0 955 703 A3 11/2001

* cited by examiner

MODULAR CONNECTOR EXHIBITING QUAD REACTANCE BALANCE FUNCTIONALITY

CROSS-REFERENCE TO RELATED APPLICATIONS

The present application is a continuation-in-part application claiming priority to a co-pending, commonly assigned non-provisional patent application entitled "Modular Insert and Jack Including Bi-Sectional Lead Frames," which was filed on Jun. 14, 2007 and assigned Ser. No. 11/818,478. The entire content of the foregoing non-provisional patent application is incorporated herein by reference.

BACKGROUND

1. Technical Field

The present disclosure relates to systems and methods for interfacing with high frequency data transfer media and, more particularly, to a modular jack housing insert assembly, such as those that are used as interface connectors for Unshielded Twisted Pair ("UTP") media, that compensates for electrical noise.

2. Background Art

In data transmission, a signal originally transmitted through a data transfer media is not necessarily the signal received. The received signal will consist of the original signal after being modified by various distortions and additional unwanted signals that affect the original signal between transmission and reception. These distortions and unwanted signals are commonly and collectively referred to as "electrical noise," or simply just "noise". Noise is the primary limiting factor related to performance of a communication system. Many problems may arise from the existence of noise during data transmission, such as data errors, system malfunctions and loss of actual desired signals.

The transmission of data, by itself, generally causes unwanted noise. Such internally generated noise arises from electromagnetic energy that is induced by the electrical energy in the individual signal-carrying lines within the data transfer media and/or data transfer connecting devices, such electromagnetic energy radiating onto or toward adjacent lines in the same media or device. This cross coupling of electromagnetic energy (i.e., electromagnetic interference or EMI) from a "source" line to a "victim" line is generally referred to as "crosstalk."

Most data transfer media consist of multiple pairs of lines bundled together. Communication systems typically incorporate many such media and connectors for data transfer. Thus, there inherently exists an opportunity for significant crosstalk interference.

Crosstalk can be categorized in one of two forms. Near end crosstalk, commonly referred to as NEXT, arises from the effects of near field capacitive (electrostatic) and inductive (magnetic) coupling between source and victim electrical transmissions. NEXT increases the additive noise at the receiver and therefore degrades the signal to noise ratio (SNR). NEXT is generally the most significant form of crosstalk because the high-energy signal from an adjacent line can induce relatively significant crosstalk into the primary signal. The other form of crosstalk is far end crosstalk, or FEXT, which arises due to capacitive and inductive coupling between the source and victim electrical devices at the far end (or opposite end) of the transmission path. FEXT is typically less of an issue because the far end interfering signal is attenuated as it traverses the loop.

A further particular distortion associated with high speed signal transmission is mismatch transmission impedances. Various interconnections occur as the signal travels down a transmission media. Each interconnection has its own internal impedance with respect to the traveling signal. For UTP cabling, the transmission media impedance is typically 100-Ohms. Offsets and/or differences from connecting devices will produce signal reflections. Signal reflections generally reduce the amount of signal energy transmitted to the receiver and distort the transmitted signal, which can lead to increased data bit loss.

Characteristics and parameters associated with electromagnetic energy waves can be derived by Maxwell's wave equations. In unbounded free space, a sinusoidal disturbance propagates as a transverse electromagnetic wave. This means that the electric field vectors are perpendicular to the magnetic field vectors lying in a plane perpendicular to the direction of the wave. As a result, crosstalk generally gives rise to a waveform shaped differently than the individual waveform (s) originally transmitted.

Unshielded Twisted Pair cable or UTP is a popular and widely used type of data transfer media. UTP is a very flexible, low cost media, and can be used for either voice or data communications. In UTP media, a pair of copper wires generally form the twisted pair. For example, a pair of copper wires with diameters of 0.4-0.8 mm may be twisted together and wrapped with a plastic coating to form a UTP cable. The twisting of the wires increases the noise immunity and reduces the bit error rate (BER) of the data transmission to some degree. Also, using two wires, rather than one, to carry each signal permits differential signaling to be used. Differential signaling is generally more immune to the effects of external electrical noise.

The non-use of cable shielding (e.g., a foil or braided metallic covering) in fabricating UTP media generally increases the effects of outside interference, but also results in reduced cost, size and installation time of the cable and associated connectors. Additionally, non-use of cable shielding in UTP fabrication generally eliminates the possibility of ground loops (i.e., current flowing in the shield because of the ground voltage at each end of the cable not being exactly the same). Ground loops may give rise to a current that induces interference within the cable, i.e., interference against which the shield was intended to protect.

The wide acceptance and use of UTP for data and voice transmission is primarily due to the large installed base, low cost and ease of new installation. Another important feature of UTP media is that it can be used for varied applications, such as for Ethernet, Token Ring, FDDI, ATM, EIA-232, ISDN, analog telephone (POTS), and other types of communication. This flexibility allows the same type of cable/system components (such as data jacks, plugs, cross-patch panels, and patch cables) to be used for an entire building, unlike shielded twisted pair ("STP") media.

Currently, UTP is being used for systems having increasingly higher data rates. Since demands on networks using UTP systems (e.g., 100 Mbit/s and 1200 Mbit/s transmission rates) have increased, it has become necessary to develop industry standards for higher system bandwidth performance. Systems and installations that began as simple analog telephone service and low speed network systems have now become high speed data systems. As the speeds have increased, so too has the noise.

The ANSI/TIA/EIA 568A standard defines electrical performance for systems that utilize the 1 to 100 MHz frequency bandwidth range. Exemplary data systems that utilize the 1-100 MHz frequency bandwidth range include IEEE Token Ring, Ethernet 10Base-T and 100Base-T.

ANSI/TIA/EIA-568.2-10 and the subsequent ANSI/TIA/EIA-568B.2 standards define a series of categories, as shown in the following table, for quantifying the quality of the cable:

| Category | Characteristic specified up to X (MHz) | Various Uses |
|---|---|---|
| 5 | 100 | TP-PMD, SONet, OC-3 (ATM), 100Base-TX |
| 5e | 100 | 10-100BASE-T |
| 6 | 250 | 100-1000BASE-TX |
| 6A | 500 | 1000-10GBASE-TX |

UTP cable standards are also specified in the EIA/TIA-568 Commercial Building Telecommunications Wiring Standard, including the electrical and physical requirements for UTP, STP, coaxial cables and optical fiber cables. For UTP, the requirements currently include:

Four individually twisted pairs per cable;

Each pair has a characteristic impedance of 100 Ohms +/−15% (when measured at frequencies of 1 to 100 MHz); and 24 gauge (0.5106-mm-diameter) or optionally 22 gauge (0.6438-mm-diameter) copper conductors are used.

Additionally, the ANSI/EIA/TIA-568 standard specifies the color coding, cable diameter, and other electrical characteristics, such as the maximum cross-talk (i.e., how much a signal in one pair interferes with the signal in another pair—through capacitive, inductive, and other types of coupling). Since this functional property is measured as how many decibels (dB) quieter the induced signal is than the original interfering signal, larger numbers reflect better performance.

Category 5 cabling systems generally provide adequate NEXT margins to allow for the high NEXT associated with use of present UTP system components. Demands for higher frequencies, more bandwidth and improved systems (e.g., Ethernet 1000Base-T) on UTP cabling, render existing systems and methods unacceptable. The TIA/EIA category 6 draft addendum related to new category 6 cabling standards illustrates heightened performance demands. For frequency bandwidths of 1 to 250 MHz, the draft addendum requires the minimum NEXT values at 100 MHz to be −39.9 dB and −33.1 dB at 250 MHz for a channel link, and −54 dB at 100 MHz and −46 dB at 250 MHz for connecting hardware. Increasing the bandwidth for new category 6 (i.e., from 1 to 100 MHz in category 5 to 1 to 250 MHz in category 6) increases the need to review opportunities for further reducing system noise.

Moreover, the TIA/EIA 568 category 6A draft-addendum for new Augmented Category 6 cabling standards for frequency bandwidths of 1 to 500 MHz for a channel link are −54 dB at 100 MHz and −34 dB at 500 MHz for connecting hardware. The requirements for Return Loss for a channel are −12 dB at 100 MHz and −6 dB at 500 MHz and for a connector its −28 dB at 100 MHz and −14 dB at 500 MHz.

A particular aspect associated with connecting hardware in which compensation for NEXT and FEXT is needed is the electrical interface modular housing. In particular, it will be necessary to reduce the noise levels in this component to meet the Category 6 and 6A standards.

The standard modular jack housing is configured and dimensioned so as to provide maximum compatibility and matability between various manufacturers, e.g., based on the FCC part 68.500 mechanical dimension. Two types of offsets have been produced from the FCC part 68.500 modular jack housing dimensions.

Type one is the standard FCC part 68.500 style for modular jack housing and such standard housing does not add or include any compensation methods to reduce crosstalk noises. The standard modular jack housing utilizes a straightforward design approach and, by alignment of lead frames in a relatively uniform, parallel pattern, high NEXT and FEXT are produced for certain adjacent wire pairs.

This type one or standard FCC part 68.500 style of modular jack housing connector is defined by two lead frame section areas. The first section is the matable area for electrical plug contact and section two is the output area of the modular jack housing. Section one aligns the lead frames in a relatively uniform, parallel pattern from lead frame tip to the bend location that enters section two, thus producing high NEXT and FEXT noises. Section two also aligns the lead frames in a relatively uniform, parallel pattern from lead frame bend location to lead frame output, thus producing and allowing additional high NEXT and FEXT noises.

Approaches exist that are intended to reduce the crosstalk noises associated with these type one or standard modular jack housings. For example, U.S. Pat. No. 6,139,371 to Troutman et al. discloses an electrical connector having an irregular bend in two lead frame of each pair frontal elongated plates and parallel at the free end of pins 3 to 5 and pins 4 to 6. This added coupling reduces crosstalk ineffectively since the elongated plates are crossed overlapped and also adjacent thus creating unwanted parallelisms 3 to 4 and 5 to 6 which increase crosstalk noises, thus becoming less effective. Although crosstalk noise may be reduced, forming lead frames with paralleled elongated plates in such a disclosed manner, may substantially increase the effective complex modes of coupling. This may potentially increase NEXT, FEXT and noise variation factors.

A further approach to reduction of crosstalk noise associated with a modular housing is described by U.S. Pat. No. 6,332,810 to Bareel. The Bareel '810 patent discloses an electrical connector having irregular bends in all 8 lead frames of each pair. Frontal coupling plates are provided on contacts 1, 3, 4, 5, 6 and 8. The coupling plates are vertically aligned and are feature an arrangement order of P1, P3, P5, P4, P6 and P8 in a housing. Positions 4 and 5 are more adjacent and are constructed on a spring beam contact with curved based portions. The metallic vertical plates are orthogonal of the plane formed by the plurality of terminals. Although crosstalk noise may be reduced, forming lead frames with elongated plates arranged in the disclosed parallel manner may substantially increase the effective complex modes of coupling, which may potentially increase NEXT, FEXT and noise variation factors.

U.S. Pat. No. 6,176,742 to Arnett et al. discloses an electrical connector having wire contacts constructed on elongated curved spring beam portions. The ends of the spring beam contacts are electrically tapped to an external capacitive arrangement of metallic plates on position 3 to 5 and 4 to 6. Positions 4 and 5 are more adjacent to a pair engaged by a mated plug. The design of the Arnett '742 patent can undesirably decrease contact flexibility which adds complexity to design. In addition, utilizing a curved spring beam contact design can increase unwanted NEXT/FEXT noises because of the adjacencies between pairs.

U.S. Pat. No. 6,443,777 to McCurdy et al. discloses an electrical connector having wire contacts constructed in an elongated wire contact arrangement. The free ends of the elongated wire contacts are electrically tapped to an external capacitive arrangement on a printed circuit board ("PCB") for positions 3 to 5 and 4 to 6, and are engaged by a mated plug.

U.S. Pat. No. 5,618,185 to Aekins discloses a further approach to noise reduction. The subject matter of the Aekins '185 patent is hereby incorporated by reference herein in its entirety for all purposes. The Aekins '185 patent describes a connector for communications systems that includes four input terminals and four output terminals in ordered arrays. A circuit electrically couples respective input and output terminals and cancels crosstalk induced across adjacent connector terminals. The circuit includes four conductive paths between the respective input and output terminals. Sections of two adjacent paths are in close proximity and cross each other between the input and output terminal. At least two of the paths have sets of vias connected in series between the input and output terminals. The sets of vias are adjacent.

Despite efforts to date, a need remains for inserts/connector systems and associated methods that offer enhanced noise reduction. These and other needs and/or limitations are addressed and/or overcome by the systems, assemblies and methods of the present disclosure.

SUMMARY

The present disclosure provides advantageous systems and methods for interfacing with high frequency data transfer media and, more particularly, modular jack housing insert assemblies, such as those that are used as interface connectors for unshielded twisted pair ("UTP") media, that compensate for electrical noise.

In exemplary embodiments of the present disclosure, the disclosed insert includes (a) an insert housing member and (b) a plurality of lead frames supported at least in part by said insert housing member. Each of the lead frames generally includes a rear end portion and a front end portion. In addition, each of at least four of the plurality of lead frames typically includes a capacitive element in electrical communication with at least the front end portion of the respective lead frame. The four lead frames are in electrical communication with capacitive elements arranged in two pairs to define a first pair of capacitive element lead frames and a second pair of capacitive element lead frames. Of note, the first pair of capacitive element lead frames and the second pair of capacitive element lead frames are spaced apart by an angle of at least thirty degrees.

In further exemplary embodiments of the present disclosure, the insert housing member includes an upper portion and a lower portion that cooperate to capture and support the plurality of lead frames. The capacitive elements associated with the first pair of capacitive element lead frames and the second pair of capacitive element lead frames are generally spaced apart from each corresponding capacitive element of the pair by at least 0.0011 inches. Each of the capacitive elements may define a substantially rectangular geometry.

The capacitive elements associated with the first pair of capacitive element lead frames are generally electrically isolated from each other and the capacitive elements associated with the second pair of capacitive element lead frames are also generally electrically isolated from each other. A first dielectric spacer may be disposed between each of the capacitive elements associated with the first pair of capacitive element lead frames and a second dielectric spacer may be disposed between each of the capacitive elements associated with the second pair of capacitive element lead frames. The capacitive elements may take various forms, e.g., metallic capacitive plates, metallic capacitive pads and combinations thereof. The capacitive elements may also be integrally formed with respect to each corresponding lead frame and, in exemplary embodiments, are coated with a dielectric coating material.

The plurality of lead frames may number eight (8) lead frames in a side-by-side orientation at an end of the insert housing member. The insert housing member is generally positioned within a jack housing that is adapted to receive a plug. In such assembly, the eight lead frames generally define two central pairs, each of the leads of the two central pairs including a capacitive element. More particularly, the insert housing may be adapted to receive a plug and the plurality of lead frames may be adapted to electrically communicate with the plug. So configured, the capacitive elements are generally adapted to compensate for crosstalk noise associated with electrical communication between the plug and the lead frames. The plurality of lead frames may be electrically mounted with respect to a printed circuit board. The printed circuit board generally includes capacitive traces and the capacitive elements are effective to compensate for noise introduced to the lead frames through connection with a plug.

In a further exemplary embodiment of the present disclosure, a jack assembly is provided that includes (a) a jack housing defining a plug-receiving space; and (b) an insert assembly positioned within the jack assembly. The insert assembly typically includes (i) an insert housing member and (ii) a plurality of lead frames supported at least in part by said insert housing member. Each of the lead frames typically includes a rear end portion and a front end portion, and each of at least four of the plurality of lead frames includes a capacitive element in electrical communication with at least the front end portion. The four lead frames are generally in electrical communication with capacitive elements arranged in two pairs to define a first pair of capacitive element lead frames and a second pair of capacitive element lead frames. Of note, the first pair of capacitive element lead frames and the second pair of capacitive element lead frames are generally spaced apart by an angle of at least thirty degrees.

With further reference to the disclosed jack assembly, each of the capacitive elements associated with each of the first pair of capacitive element lead frames and the second pair of capacitive element lead frames are generally spaced apart from each corresponding capacitive element of the pair by at least 0.0011 inches. The capacitive elements generally define a substantially rectangular geometry. In addition, the capacitive elements associated with the first pair of capacitive element lead frames are typically electrically isolated from each other and the capacitive elements associated with the second pair of capacitive element lead frames are also typically electrically isolated from each other.

First and second dielectric spacers may be disposed between each of the capacitive elements associated with the first and second pairs of capacitive element lead frames. The capacitive elements may be fabricated from various materials, e.g., metallic capacitive plates, metallic capacitive pads and combinations thereof. The capacitive elements may be integrally formed with respect to each corresponding lead frame and the capacitive elements may be advantageously coated with a dielectric coating material.

The plurality of lead frames generally includes eight (8) lead frames in a side-by-side orientation exposed to the plug-receiving space. More particularly, the eight lead frames may define two central pairs, each of the leads of the two central pairs including a capacitive element, and the two central pairs being characterized as the first and second pair of capacitive element lead frames. The insert housing is generally adapted to receive a plug and the plurality of lead frames are adapted to electrically communicate with the plug. In addition, the capacitive elements are generally adapted to compensate for crosstalk noise associated with electrical communication between the plug and the lead frames.

The present disclosure further provides a method for accommodating plugs having differing contact layouts. In an exemplary method of the present disclosure, a jack assembly that defines a plug-receiving space is provided, the jack assembly supporting a plurality of lead frames accessible to the jack-receiving space. The plurality of lead frames generally include: (i) eight lead frames in side-by-side relation defining two central pairs of lead frames, wherein each lead frame defines a front portion and a rear portion; and (ii) at least one capacitive element positioned on each of the front portions of each of the lead frames associated with the central two pairs, wherein the two central pairs of lead frames are spaced apart by an angle of at least thirty degrees. The disclosed method further generally includes insertion of a plug into the plug-receiving space of the jack assembly, and automatic compensation for noise generated through insertion of the plug into the plug-receiving space. Each of the capacitive elements generally defines a substantially rectangular geometry, is electrically isolated from a capacitive element associated with the other corresponding lead frame of the pair of lead frames, and is characterized by a member selected from the group consisting of metallic capacitive plate, metallic capacitive pad and combinations thereof.

Additional features, functions and benefits of the disclosed systems and methods will be apparent from the description which follows, particularly when read in conjunction with the appended figures.

BRIEF DESCRIPTION OF THE DRAWINGS

To assist those of ordinary skill in the art in making and using the disclosed assemblies and methods, reference is made to the appended figures, wherein.

DESCRIPTION OF EXEMPLARY EMBODIMENT(S)

Figure 1:
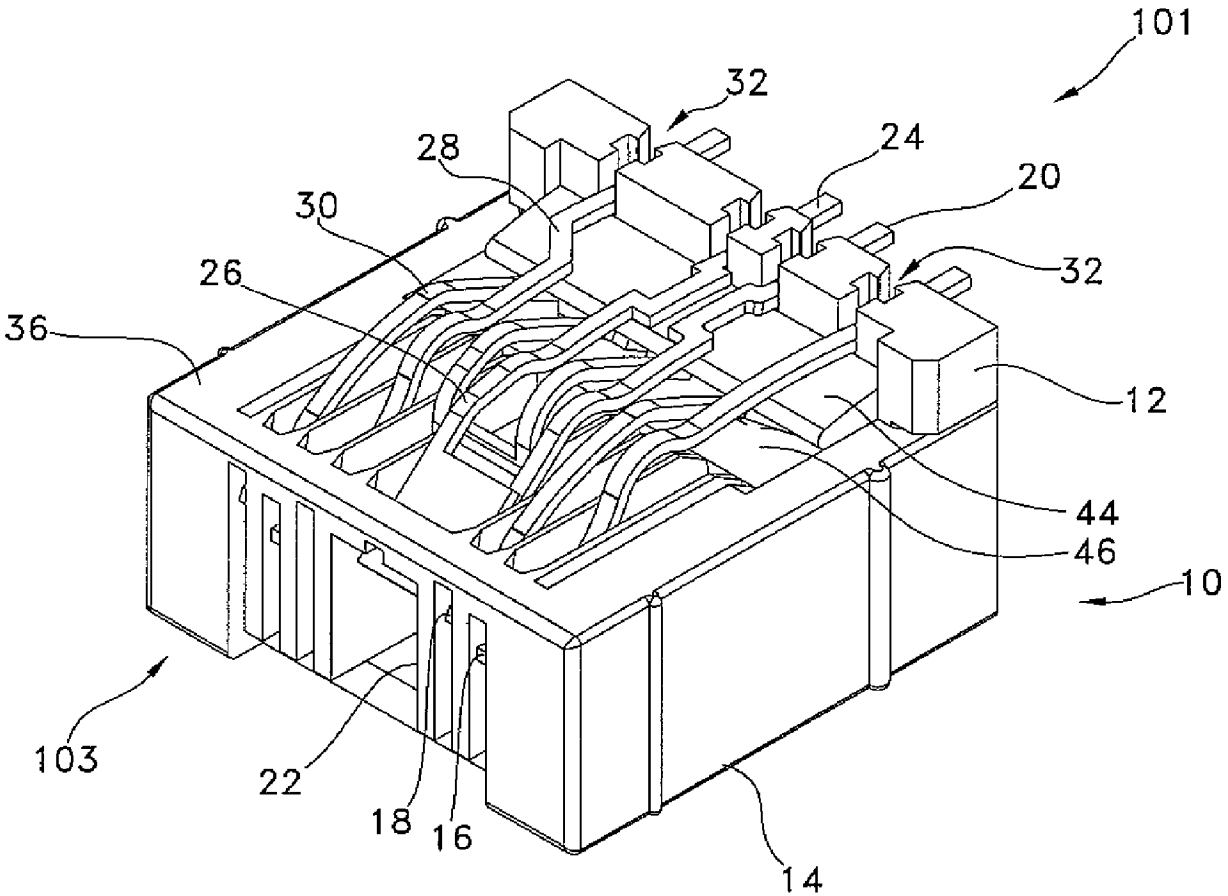
FIG. 1 is a perspective view of an exemplary insert device in accordance with the present disclosure.

The present disclosure provides advantageous connector systems, designs and methods that offer enhanced noise reduction. Referring now to the drawings, FIGS. 1-10 illustrate an embodiment of a dielectric interface modular insert 10 in accordance with the present disclosure. Insert 10 has an upper portion 12 seated on a lower portion 14, with electrically conductive lead frames 16, 18, 20, 22, 24, 26, 28 and 30 being disposed between. Preferably, upper portion 12 and lower portion 14 are fabricated from a low dielectric material, such as plastic.

Insert 10 contains terminals having 8 lead frames in accordance with most standard wiring formations, such as the T568B and T568A style RJ45 plugs. The TIA/EIA commercial building standards have defined Category 5e to 6A electrical performance parameters for higher bandwidth (100 up to 500 MHz) systems. In Category 5e to 6A, the TIA/EIA RJ 45 wiring style is a preferred formation and is used extensively throughout the cabling industry.

Lead frames 16 through 30 are engaged in channel slots 32 with cut outs in upper portion 12 and lower portion 14. The cut outs are provided so as to permit contact portions 34 on each lead frame to be exposed along upper surface 36. Slots 32 also hold the lead frames 16 through 30 in position prior to being inserted into a PCB. The present disclosure provides for an exemplary insert 10 whereby each of upper portion 12 and lower portion 14 define a plurality of slots 32. In an exemplary embodiment, lead frames 16, 20, 24 and 28 are associated with slots 32 defined with respect to upper portion 12 and lead frames 18, 22, 26 and 30 are associated with slots 32 defined with respect to lower portion 14.

Typically, slots 32 are defined with respect to a rear side 101 of insert 10. The lead frames can be mounted with respect to a PCB 104 along rear side 101. The lead frames generally extend forwardly towards front side 103. This allows for curved portions associated with reach lead frame to be exposed with respect to upper surface 36.

Each of lead frames 20 and 24 include front portions extending towards front side 103. The present disclosure provides for capacitive elements, such as metallic plates/pads 113 and 115 positioned with respect to the front portions of each of lead frames 20 and 24 respectively. Plates 113 and 115 are in electrical communication with each associated lead frame to provide for effective noise compensation. In an exemplary embodiment, the metallic plates define a rectangular geometry as illustrated with respect to FIG. 3. Plates 113 and 115 positioned about substantially parallel planes with respect to each other. In an exemplary embodiment, plate 115 associated with lead frame 24 is sized and shaped to be positioned substantially over plate 113 associated with lead frame 20.

Plates 113 and 115 are typically spaced apart a desired distance. In an exemplary embodiment, they are spaced apart a distance of at least 0.012 inches. The plates can be integrally formed on each of the lead frames and should be electrically isolated from each other. In a further exemplary embodiment, the plates can be electrically isolated from each other by coating each plate with a spray dielectric coating material. It is further possible to electrically isolate each plate by providing a dielectric spacer disposed between the two plates.

Each of lead frames 22 and 26 include front portions extending towards front side 103. The present disclosure provides for capacitive elements, such as metallic plates/pads 114 and 116 positioned with respect to the front portions of each of lead frames 22 and 26 respectively. Plates 114 and 116 are in electrical communication with each associated lead frame to provide for effective noise compensation. In an exemplary embodiment, the metallic plates define a rectangular geometry as illustrated with respect to FIG. 2. Plates 114 and 116 are positioned about substantially parallel planes with respect to each other. In a exemplary embodiment, plate 116 associated with lead frame 26 is sized and shaped to be positioned substantially over plate 114 associated with lead frame 22.

Plates 114 and 116 are typically spaced apart a desired distance. In an exemplary embodiment, they are spaced apart a distance of at least 0.012 inches. The plates can be integrally formed on each of the lead frames and should be electrically isolated from each other. In a further exemplary embodiment, the plates can be electrically isolated from each other by coating each plate with a spray dielectric coating material. It is further possible to electrically isolate each plate by providing a dielectric spacer disposed between the two plates. In an exemplary embodiment, the front portions associated with each of lead frames 20 and 24 are curved and spaced apart an angle of at least thirty degrees away from the front portions associated with each of lead frames 22 and 26. This spacing can be seen with respect to FIG. 5.

The present disclosure provides for an insert 10 including lead frames 16 through 30 traversing insert 10 from rear side 101 to front side 103. Typically, the lead frames are substantially parallel with respect to each other. Each lead frame 16 through 30 is substantially elongated with curved or bent body portions 33. Each lead frame typically includes: (i) a contact portion 34; (ii) a front portion 41; (iii) opposing second end portion 35; and (iii) an electrical connector pin 42 extending through slot 32. Connector pins 42 extend outwardly from insert 10 with respect to rear side 101 and may be adapted to mate with other components or cables. Lead frames 16 through 30 are substantially parallel and spaced in their engagement so that contact portions 34 correspond with leads associated with an exemplary RJ45 plug 108 (shown in FIG. 10). Thus, by way of example, a first pair of a T568B four-paired plug (i.e., eight corresponding leads) would align with lead frames 22 and 24, a second pair with lead frames 16 and 18, a third pair with lead frames 20 and 26, and a fourth pair with lead frames 28 and 30.

In an exemplary embodiment, upper portion 12 further includes a curved support ramp 44 (shown in FIG. 1) which extends under a portion of lead frames 16, 20, 24 and 28 for at least the purpose of supporting and increasing the flexibility of the lead frames. Similarly, lower portion 14 further includes a ramped support portion 46 (shown in FIG. 1) which extends under a portion of lead frames 18, 22, 26 and 30. The present disclosure further provides for an exemplary modular insert having channel guilds (not shown) open along the surface of front side 103 on lower portion 14 and engage ends 41 of lead frames 16-30. Each of lead frames 16, 18, 20, 22, 24, 26, 28 and 30 correspond to an exemplary individual channel guild respectively.

Curved body portions 33, associated with lead frames 16 through 30, are typically positioned substantially parallel with respect to each other and are spaced apart to mate with a standard FCC RJ45 plug. Connector pins 42 extend outwardly from insert 10 at front side 103. As shown with respect to FIG. 7, lead frames 16 through 30 can be uniquely positioned with respect to each other as compared to prior positioning schemes. Unique positioning as shown with respect to FIG. 7 results in advantageously reducing unwanted noises due to the offset angling.

Figure 7:
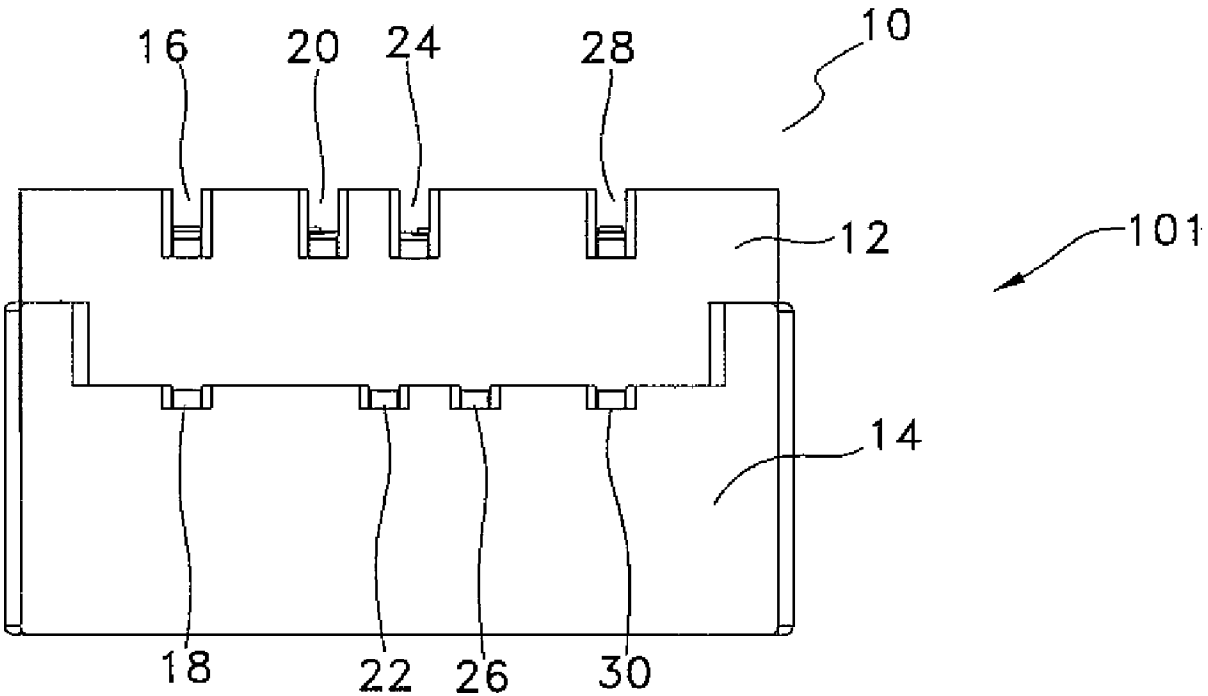
FIG. 7 is a rear plan view of the insert of FIG. 1.

Referring to upper portion 12 (as shown in FIG. 7), in an exemplary embodiment, the distance between lead frame 28 and 24 is about 0.190 inch, the distance between lead frame 24 and 20 ranges from about 0.050 to 0.060 inches, and the distance between lead frame 20 and 16 is about 0.1 inch. Referring to lower portion 14 (as shown in FIG. 7), the distance between lead frame 30 to 26 is about 0.1 inch, the distance between lead frame 26 to 22 ranges from about 0.050 to 0.060 inches, and the distance between lead frame 22 to 18 is about 0.190 inch. Preferably, the distance between pins 42 from the lead frames in the lower portion 14 to the lead frames in the upper portion 12 is at least about 0.1 inch. This exemplary arrangement serves to at least provide for the benefit of reducing pair to pair noise, which is generally introduced to the system by the TIA/EIA T568B/A plug.

Typically, lead frames 30, 26, 22, and 18 associated with insert 10 are designated ring R' (i.e., negative voltage transmission) and lead frames 28, 24, 20, and 16 are designated tip T' (i.e., positive voltage transmission) polarity. For T568B category 5e and 6 frequencies, unwanted noise is induced mainly between contacts 26, 24, 22, and 20, and minor unwanted noises are introduced between contacts 18 and 20 as well as contacts 26 and 28.

Lead frames 16 through 30 are electrically short in reference to the wavelengths up to 250 MHz. According to the present disclosure, lead frames 16 through 30 optimally affect the created noise as close to the source as possible to reduce noise phase offsets and create a proper balance of the noises created by a modular plug. The offset regions are affected by the distance of compensation reactance to the original noise reactance. Thus, the further away from the source of the noise signal, the greater the offset will be. Re-balancing the original signal to remove the noise signal is best achieved by using a signal of opposite polarity than the noise signal. According to the present disclosure, an optimal point for creation of a re-balancing signal is within 0.2 inches of the noise creation region because such distance generally provides equal magnitude and phase to the original negative noise region, among other things.

Lead frames 16 through 30 are arranged in such a manner that unwanted noise via coupling in an EIA RJ45 T568B system having standard plug positions 1, 2, 3, 4, 5, 6, 7 and 8, is reduced in comparison to the standard RJ45 modular inserts. Such advantageous reduction according to the present disclosure is primarily achieved because standard RJ45 modular inserts typically have plug positions and lead frames that disadvantageously remain parallel and adjacent throughout the insert.

Figure 2:
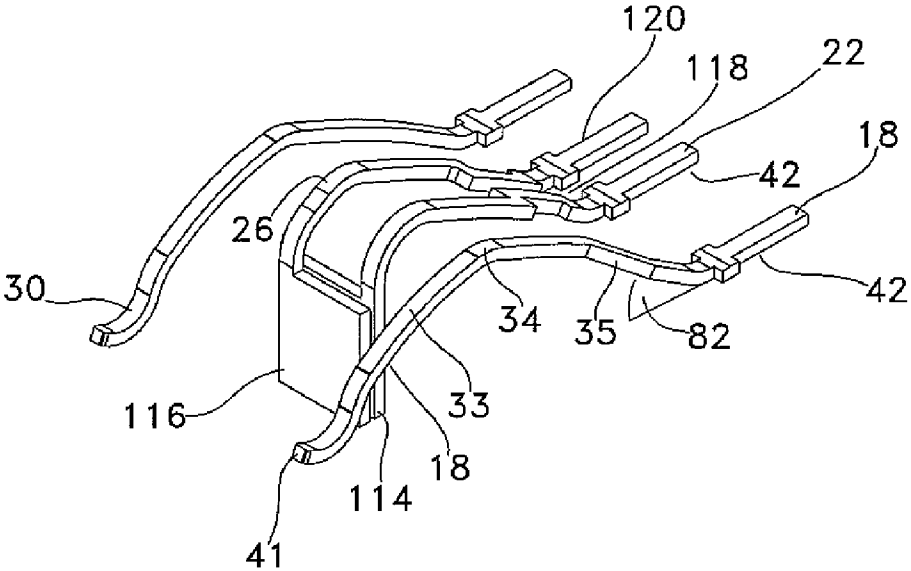
FIG. 2 illustrates exemplary lead frames associated with a lower portion of the insert of FIG. 1.

FIG. 2 illustrates the curvature of body portion 33 in lead frames 18, 22, 26 and 30. Lead frames 18, 22, 26 and 30 are substantially parallel along a longitudinal axis extending from rear side 101 to front side 103. Lead frames 18, 22, 26 and 30 are typically curved upward with respect to insert 10 at an angle 82. In an exemplary embodiment, angle 82 is about thirty degrees. A thirty degree angle provides for the pre-load stress of mating with a plug and may increase lead frame contact force to an estimated one hundred grams or more, among other things.

Capacitive plates 114 and 116 are positioned with respect to front side portions (also referred to as free ends) of each of lead frames 22 and 26 respectively. In an exemplary embodiment, plates 114 and 116 are spaced away from each other at a distance of at least 0.011 inches. In a further exemplary embodiment, plates 114 and 116 are spaced apart a distance of at least 0.011 inches when a dielectric substance is disposed there between. Typically, the plates should be spaced apart at a distance away from a point of plug mated contact to effectively reduce NEXT noises that may be created from the plug.

Figure 4:
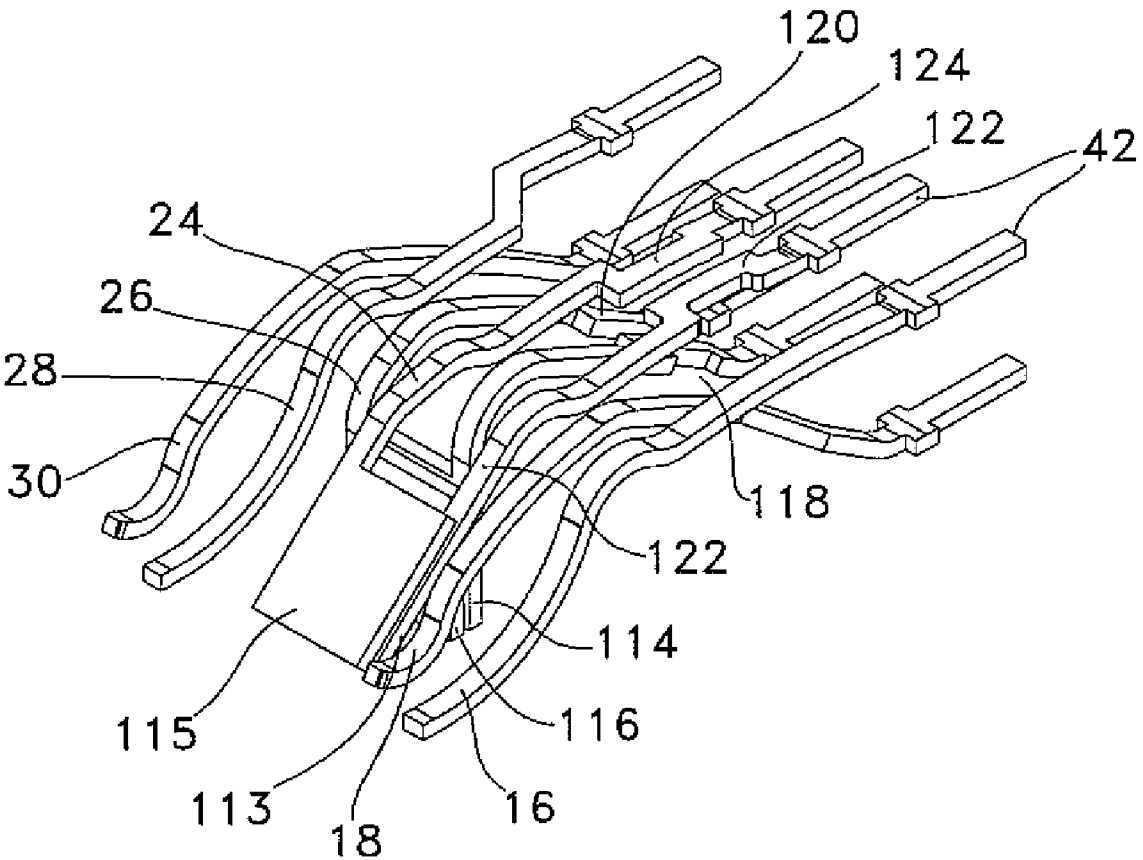
FIG. 4 is a perspective view of the lead frames associated with the lower and upper portion of the insert of FIG. 1 shown in combination.
Figure 6:
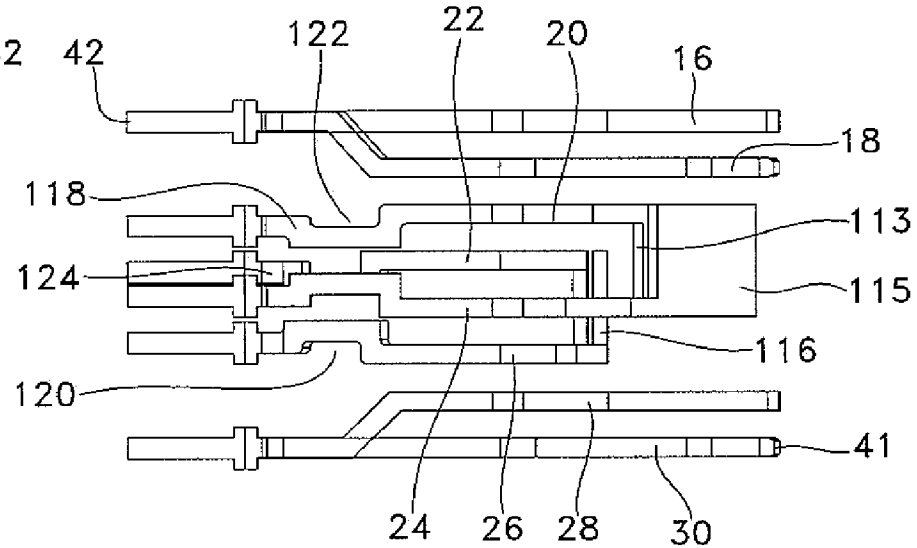
FIG. 6 is a top plan view of the lead frames associated with the lower and upper portion of the insert of FIG. 1 shown in combination.

In an exemplary embodiment, the plates are spaced apart an average distance from the point of plug mated contact of at least 0.113 inches. This distance may allow for counter balancing of injected noise, since the distance is a relatively electrically short distance and can produce near instantaneous feedback of balancing noise vectors. Plates 114 and 116 are sized and shaped to produce estimated 1 pF of capacitance reactance which is dependant of the dielectric material and the controlled distances of the plates. At the PCB end (rear side 101), terminals of the leads are formed to produce further capacitance and inductance reactance 118 and 120 respectively (as shown in FIG. 2, FIG. 4, and FIG. 6). An average distance of 0.113 is again utilized to counter balance the injected noise, since the distance is relatively electrically short and may produce near instantaneous feedback of balancing noise vectors.

Figure 3:
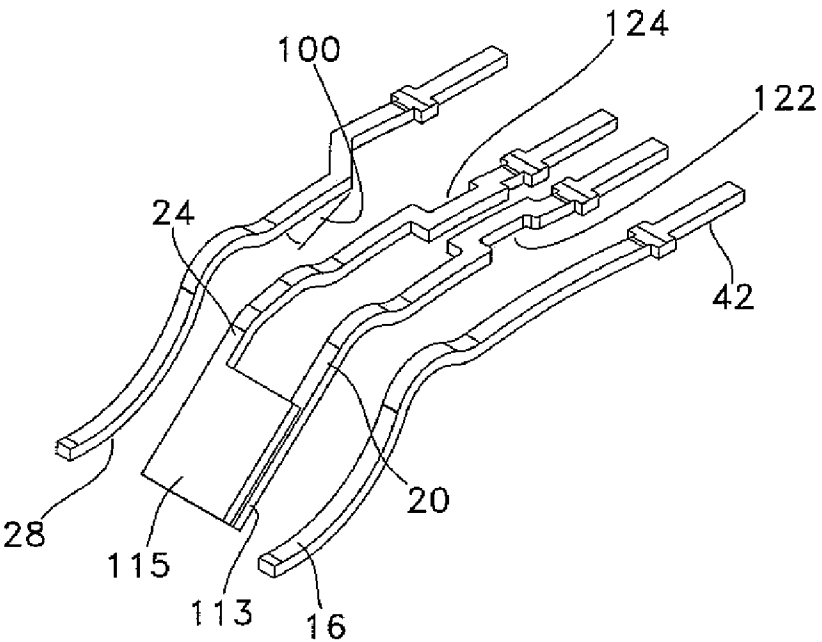
FIG. 3 illustrates exemplary lead frames associated with a top portion of the insert of FIG. 1.

FIG. 3 illustrates the curvature of body portion 33 in lead frames 16, 20, 24 and 28. Lead frames 16 and 28 are substantially parallel along a longitudinal axis extending from rear side 101 to front side 103. Lead frames 16, 20, 24 and 28 are typically curved upward with respect to insert 10 at an angle 100. Lead frames 20 and 24 are curved away from lead frames 16 and 28 respectively in a reverse direction to avoid electrical shorting with lead frames 22 and 26 and plates 114 and 116. Lead frames 20 and 24 are curved upward with respect to insert 10 at an angle 100. In an exemplary embodiment, angle 100 is about ten degrees. A ten degree angle provides for the pre-load stress of mating with a plug and may increase lead frame contact force to an estimated one hundred grams or more, among other things.

Capacitive plates 113 and 115 are positioned with respect to the front side portions (also referred to as free ends) of each of lead frames 20 and 24 respectively. In an exemplary embodiment, plates 113 and 115 are spaced away from each other at a distance of at least 0.011. In a further exemplary embodiment, plates 113 and 115 are spaced apart a distance of at least 0.011 inches when a dielectric substance is disposed there between. Typically, the plates should be spaced apart at a distance away from a point of plug mated contact to effectively reduce NEXT noises that may be created from the plug.

In an exemplary embodiment, the plates are spaced apart an average distance from the point of plug mated contact of at least 0.116 inches. This distance may allow for counter balancing of the injected noise, since the distance is a relatively electrically short distance and can produce near instantaneous feedback of balancing noise vectors. Plates 113 and 115 are sized and shaped to produce estimated 1 pF of capacitance reactance which is dependant of the dielectric material and the controlled distances of the pads. At the PCB end (rear side 101), terminals of the leads are formed to produce further capacitance and inductance reactance 122 and 124 respectively (as shown in FIG. 3, FIG. 4, and FIG. 6). An average distance of 0.116 is again utilized to counter balance the injected noise, since the distance is relatively electrically short and may produce near instantaneous feedback of balancing noise vectors.

Figure 5:
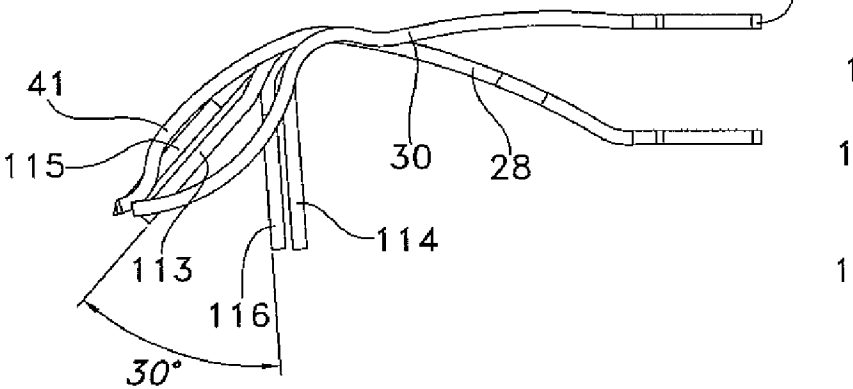
FIG. 5 is a side plan view of the lead frames associated with the lower and upper portion of the insert of FIG. 1 shown in combination.

FIGS. 4, 5 and 6 illustrate the combination of the two sets of pins, the top half (leads 16, 20, 24, and 28) associated with top portion 12 and the bottom half (leads 18, 22, 26, and 30) associated with bottom portion 14. In an exemplary embodiment, an angle of separation between the two sets of plates (plates 113 and 115 being a first set and plates 114 and 116 being a second set) is at least thirty degrees or more. FIGS. 4-6 show that the inner most plates (114 and 116) are of a differential pair on contact sets 22 and 24 respectively, and correspond to EIA 568-B.2 RJ45 pair 1 configuration. This precise arrangement is required for the inner most contacts from differential signal pair sets to reduce the complex mode of coupling to one.

The complex reactance modes Xc are 114Xc→116Xc and 118Xc→120Xc for one half of the differential signal and the other half of the differential signal complex reactance modes Xc are 113Xc→115Xc and 122Xc→124Xc. All Quad (4) Xc sections are separated zones, thus reducing the stray EMI between sections which provides a more effective and balanced attach to reduce unwanted coupled signal noises. The inner most contacts could also be contacts 20 and 26 with its respective plates being differential signal pair 3 of an EIA 568-B.2 RJ45 pin configuration. This configuration aids in improving impedance for differential signal pair 3, whose leads are normally split and therefore reducing its line capacitive reactance balance. Balance is re-inserted with plates of like pairs capacitance of the differential signal pair being inner most combination. The lead arrangement could also be done with leads 20 and 24 with plates 113 and 115 being the forward most lead set and the leads 22 and 26 with plates 114 and 116. This arrangement of Quad Xc accomplishes the same benefit but provides another option for mechanical assembly.

As illustrated in FIGS. 5, 6 and 7, inclusion of the various direction-altering segments in lead frames 16 through 30 results in a placement of pins 42 at end 35 which does not necessarily reflect the relative order of lead frames 16 through 30 at end 41. FIG. 6 also illustrates the non crossover of leads 20, 22, 24 and 26. Signal carrying leads 22 and 24 are overlapped at terminal ends 118 and 124 respectively. FIG. 7 also illustrates the non crossover but overlapping of leads 22 and 24 when placed inside dielectric devices top portion 12 and bottom portion 14.

Figure 8:
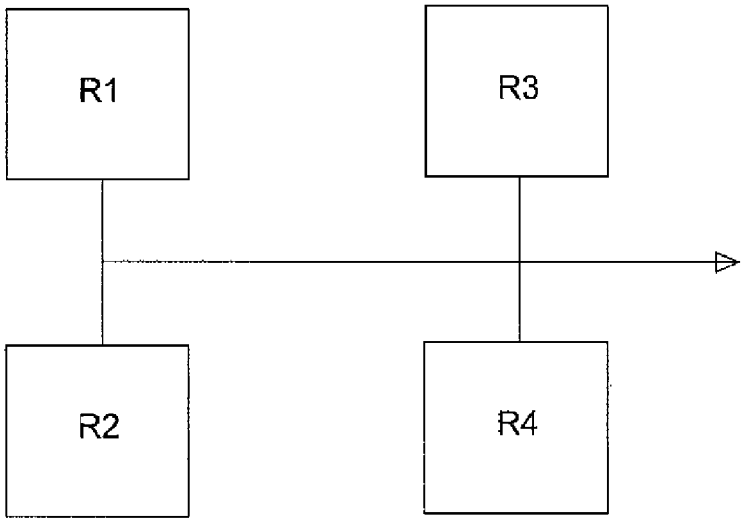
FIG. 8 is a reactance block diagram of the embodiment of the present disclosure depicted in FIG. 1.

FIG. 8 illustrates a block diagram of the difference of isolated Xc sections associated with an exemplary embodiment of the present disclosure along signal carrying contacts. Typically, a RJ Plug is electrically mated in-between the front R1-R2 isolated Xc and the rear R3-R4 isolated Xc. Each individual block contains a capacitive and/or inductive reactance circuitry. The reactive circuitry is design to couple opposite signal magnitudes to the appropriate noise effective lines.

Figure 9:
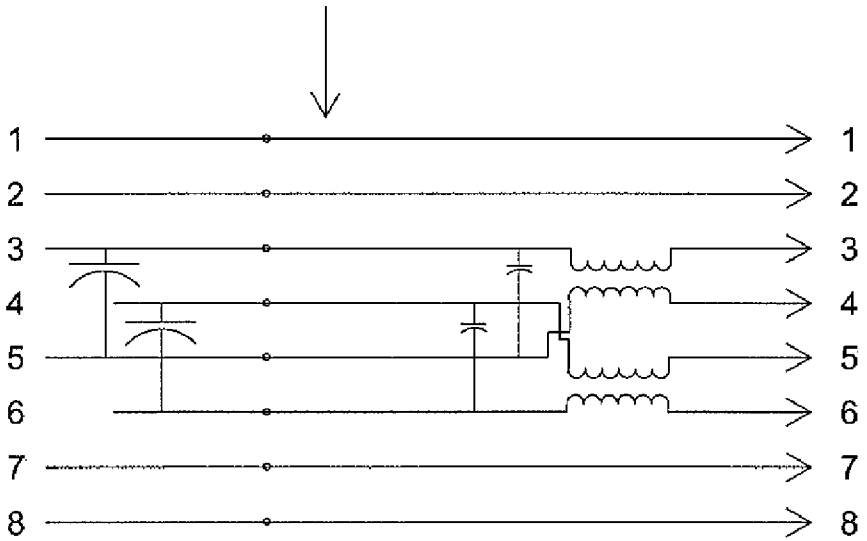
FIG. 9 is a reactance schematic diagram of the embodiment of the present disclosure depicted in FIG. 1.

FIG. 9 illustrates an electrical schematic diagram of the difference of isolated Xc sections associated with an exemplary embodiment of the present disclosure along signal carrying contacts. The diagram illustrates a RJ Plug electrically mated in-between the front isolated Xc and the rear isolated Xc at the arrow location on all eight lines. Each individual Xc is part capacitive and/or a capacitor and inductive reactance circuitry. Xc circuits are formed between pairs of adjacent transmission lines where a capacitor and/or combination circuit is utilized for compensation. At a time t, pair 1 may have signal magnitudes with polarities of positive on line 4 and negative line 5, and pair 3 is affected with positive noise coupled on lines 3 and negative noise coupled on line 6. The Xc circuits are generally designed to couple opposite signal magnitudes (i.e. line 5 to line 3 and line 4 to line 6) to the appropriate noise effective lines. This is to counter balance the effected noise lines with two opposing signals magnitudes to effectively reduce the overall noises.

Figure 10:
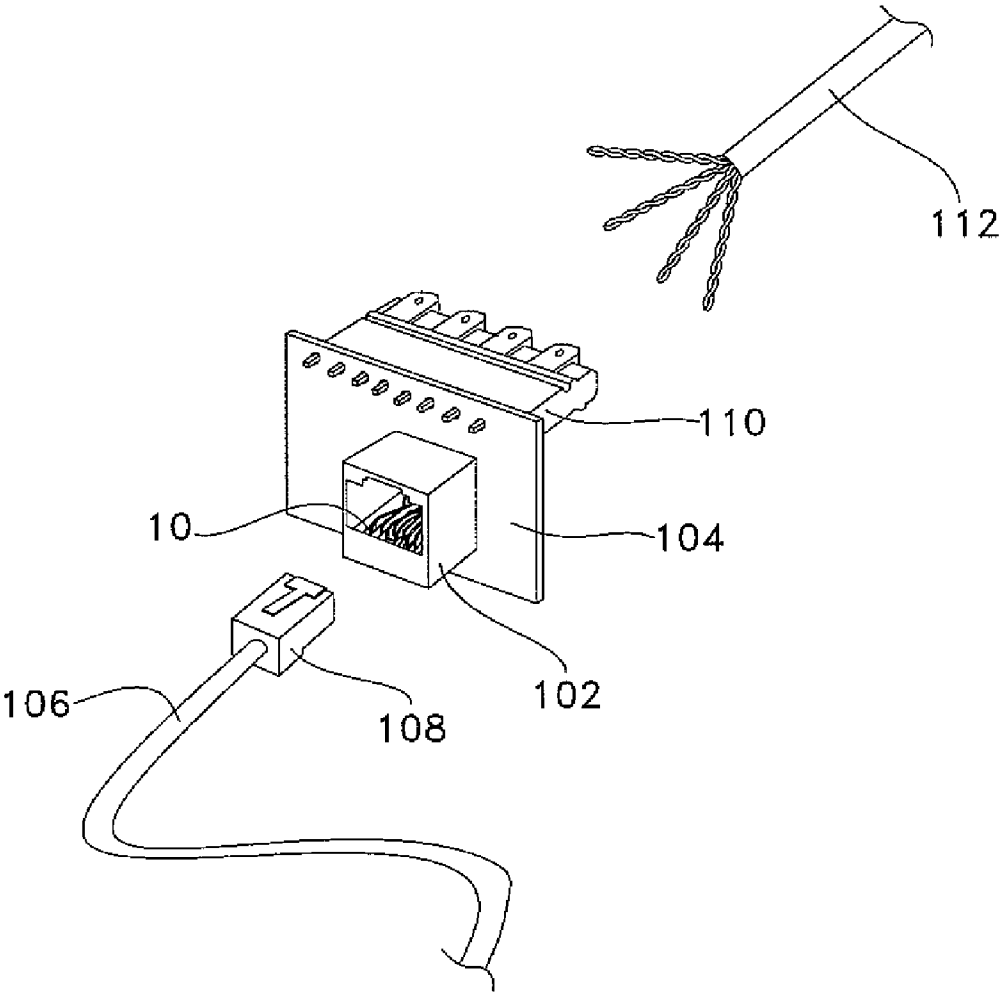
FIG. 10 illustrates an exemplary embodiment of a modular jack assembly according to the present disclosure mounted with respect to a PCB and adapted to receive a plug.

FIG. 10 illustrates use of exemplary inserts and jacks of the present disclosure. Insert 10 is secured in modular housing 102 of a standard jack assembly for use in various applications, e.g., connection with a network wall outlet, computer or other data transfer device. Modular housing 102 with insert 10 is electrically mounted with respect to a printed circuit board ("PCB") 104 which may also contain signal transmission traces and/or extra coupling circuitry for re-balancing signals. Signals transfer from UTP cable 106 and into insert 10 through RJ45 type plug 108. Signals from cable 106 can be transmitted via plug contacts (not shown) in plug 108, which make electrical contact substantially at contact portions 34 associated with lead frames 16 through 30. Each pair of plug contacts mates with a lead frame associated with upper portion 12 and a lead frame associated with lower portion 14 of insert 10. The signal transfers from insert 10 via pins 42 into PCB 104. The signal is transferred from PCB 104 to insulation displacement contacts ("IDC") 110 which is connected to a second UTP cable 112, thus completing the data interface and transfer through insert 10.

In a 4 pair connecting hardware system, multiple pairs of plug contacts for data signal transmission are provided. These contact positions generally correspond to or couple with respect to corresponding lead frames. A first pair of plug contacts mates with lead frames 22 and 24, a second pair with lead frames 16 and 18, a third pair with lead frames 20 and 26, and a fourth pair with lead frames 28 and 30.

A significant portion and, in many instances, a majority of the coupled noise associated with the RJ45 plug arises from the adjacency of the paired arrangements. On a relative basis, the worst case NEXT noise in a RJ45 plug is a balance coupled negative noise, meaning the noise is coupled equally upon the adjacent pairs. Thus, the worst effect in a 4 pair RJ45 plug module is typically exhibited in plug contacts numbered as 3, 4, 5 and 6 (inner most contacts (not shown)), corresponding to lead frames 20 through 26, because both sides of the transmitting and receiving signal are adjacent to each other. The other pairs of a RJ45 plug also create noise problems, but such problems are of significantly lesser magnitude because only one wire of the pair is the noise source.

With further reference to the Figures, the input signal from plug 108 is split into two separate reactances at contact portion 34. One portion of the signal is directed towards end portion 35 of the lead frames and the other towards end portion 41 of the lead frames. The signal portion directed towards end 35 of the lead frames flows into PCB 104 for energy transmission to the output UTP cable 112 connected with IDC 110. Signals in lead frames 22 and 24 of pair 1 are capacitively and inductively coupled upon pair 3 connected lead frames 20 and 26, e.g., by approximately 0.18 pF, which increases the positive signal inductance coupling by approximately 3.6 nH. Lead frame 20 from pair 3 is capacitively and inductively coupled upon the lead frame 18 from pair 2, e.g., by approximately 0.11 pF, which increases the positive signal inductance coupling by approximately 3.1 nH. The lead frame 24 from pair 1 is also designed to reduce its coupling effect upon the lead frame 30 from pair 2 by reducing its parallelism via direction-altering segments in the lead frames.

The signal portion directed away from PCB 104 toward end portions 41 of the lead frames results in static energy coupling from the input signals. Lead frames 22 or 24 of pair 1 are capacitively coupled upon lead frames 20 or 26 of pair 3. Also, lead frames 20 or 26 from pair 3 are capacitively coupled upon lead frames 18 or 16 from pair 2 and lead frames 28 and 30 from pair 4. A portion of lead frames 22 or 24 of pair 1 is capacitively coupled upon one lead frame 28 or 30 of pair 4 and lead frame 16 or 18 of pair 2.

The formation of lead frames 16 through 30 results in splitting the signal and reducing crosstalk noises by, among other things, causing separate and quad reactances, that is, one being the rear-end dual inductive/capacitive reactances section combination and the other being the dual static mode capacitive reactance at the free end of the elongated contacts central pairs. The lead frames may be arranged and/or bent in different formats. One format aligns all contacts in order, which increases the parallelism of the wire pairs. The other format, in accordance with the present disclosure, aligns all contacts in two distinct bends, with the lead frames associated with upper portion 12 in parallel to each other, and the lead frames associated with the lower portion 14 in parallel to each other, but not parallel with regard to lead frames of differing associations, which reduces NEXT more effectively.

By enhancing and reducing the parallelism of the lead frames at opposing end portions in accordance with the known coupling problems inherent in the RJ45 plug system, lower capacitive and inductive coupling will occur as the frequency increases up to 500 MHz. The advantageous end result is an insert device that has lower NEXT, FEXT and impedance in certain wire pairs. The reduction of a majority of crosstalk noise occurs by combining indirect and direct signal coupling in the lead frames associated with central pairs 1 and 3, as well as the other pairs 2 and 4 in the RJ45 plug.

Negative noise that was introduced is optionally counter coupled with a balance quad (4-section) positive noise, therefore reducing the total noise effects and re-balancing the wire pairs output. Each balance coupling section is located in separated isolated zones. By placement of such sections in isolated zones, the interaction of electro magnetic interference (EMI) between sections is greatly reduced. Such functionality may also be effective to reduce coupling variations.

The lead frames are generally electrically short, approximately less than 0.27 inches in length, which reduces the negative noise coupling by reducing the parallelism of the adjacent victim wire and reducing the signal delay to a PCB that could contain further coupling circuitry. The additive positive noise and reduction of the unwanted negative noise coupling of the lead frames works at substantially the same moment in time, which allows optimal reduction for lower capacitive and inductive coupling. The combination of the split signals provides, inter alia, an enhanced low noise dielectric modular housing for high speed telecommunication connecting hardware systems. The end result is a modular insert device that has lower NEXT, FEXT and impedance within its wire pairs.

Thus, the present disclosure provides a system, device and method for reducing crosstalk noise without requiring new equipment or expensive re-wiring. The victim crosstalk noise is eliminated by a combination of the appropriately placed positive feedback signal reactance circuitry and by utilizing a noise balancing quad reactance dielectric insert. This operation is accomplished by forming the appropriate contacts within the quad reactance dielectric insert for noise reduction. By using the quad reactance dielectric insert, the amount of unwanted signals can be induced to cancel that which was injected by the plug input, thus increasing the system's signal to noise ratio and network's bit error rate.

This method and system approach provides a more laboratory controlled product than other crosstalk reduction designs, which greatly improves design time, efficiency and cost. This method and system approach also provides a way to effectively remove crosstalk in a very small amount of printed circuit board space as compared to conventional crosstalk reduction designs.

Signal noise is re-balanced by the offsetting change in lead frame design, i.e., from a parallel to asymmetrical or almost perpendicular relationship between respective lead frames in the dielectric insert before the signal enters into the PCB. Exemplary devices in accordance with the present disclosure have a typical NEXT value of no greater than −46 dB and a FEXT value that is typically no greater than −50 dB. A standard modular insert typically exhibits a NEXT value of −37 dB and the FEXT is typically −40 dB.

An insert device according to the present disclosure thus reduces the differential noise input voltage ratio signal by at least seventy percent. This reduction and controlled Xc also aid in reducing the cabling Power Sum Alien Crosstalk (PSANEXT). Reducing the NEXT noise essentially also reduces the amount of necessary coupling energy which has the potential to radiate upon an adjacent line. PSANEXT as described in the EIA 568-B.2-10 document is a particular noise parameter that has limit margin requirements for proper 10GBASE-T signal transmission over copper cabling.

Although the present disclosure has been described with reference to exemplary embodiments and implementations thereof, the disclosed assemblies and methods are not limited to such exemplary embodiments/implementations. Rather, as will be readily apparent to persons skilled in the art from the description provided herein, the disclosed assemblies and methods are susceptible to modifications, alterations and enhancements without departing from the spirit or scope of the present disclosure. Accordingly, the present disclosure expressly encompasses such modification, alterations and enhancements within the scope hereof.

What is claimed:

1. An insert for use in a communication jack, comprising:

(a) an insert housing member;

(b) a plurality of lead frames supported at least in part by said insert housing member;

wherein each of the lead frames includes a rear end portion and a front end portion;

wherein each of at least four of the plurality of lead frames includes a capacitive element in electrical communication with at least the front end portion;

wherein the four lead frames in electrical communication with capacitive elements are arranged in two pairs to define a first pair of capacitive element lead frames and a second pair of capacitive element lead frames; and wherein the first pair of capacitive element lead frames and the second pair of capacitive element lead frames are spaced apart by an angle of at least thirty degrees.

2. The insert of claim 1, wherein the insert housing member includes an upper portion and a lower portion that cooperate to capture and support the plurality of lead frames.

3. The insert of claim 1, wherein each of the capacitive elements associated with each of the first pair of capacitive element lead frames and the second pair of capacitive element lead frames are spaced apart from each corresponding capacitive element of the pair by at least 0.0011 inches.

4. The insert of claim 1, wherein each of the capacitive elements defines a substantially rectangular geometry.

5. The insert of claim 1, wherein the capacitive elements associated with the first pair of capacitive element lead frames are electrically isolated from each other and the capacitive elements associated with the second pair of capacitive element lead frames are electrically isolated from each other.

6. The insert of claim 1, wherein a first dielectric spacer is disposed between each of the capacitive elements associated with the first pair of capacitive element lead frames and a second dielectric spacer is disposed between each of the capacitive elements associated with the second pair of capacitive element lead frames.

7. The insert of claim 1, wherein the capacitive elements are characterized by a member selected from the group consisting of metallic capacitive plates, metallic capacitive pads and combinations thereof.

8. The insert of claim 1, wherein the capacitive elements are integrally formed with respect to each corresponding lead frame.

9. The insert of claim 1, wherein the capacitive elements are coated with a dielectric coating material.

10. The insert of claim 1, wherein the plurality of lead frames includes eight (8) lead frames in a side-by-side orientation at least one end of the insert housing member.

11. The insert of claim 10, wherein the insert housing member is positioned in a jack housing adapted to receive a plug.

12. The insert of claim 10, wherein the eight lead frames define two central pairs, each of the leads of the two central pairs includes a capacitive element, and wherein the two central pairs are characterized as the first and second pair of capacitive element lead frames.

13. The insert of claim 1, wherein: (i) the insert housing is adapted to receive a plug; (ii) the plurality of lead frames are adapted to electrically communicate with the plug; and (iii) the capacitive elements are adapted to compensate for crosstalk noise associated with electrical communication between the plug and the lead frames.

14. The insert of claim 1, wherein the plurality of lead frames includes eight (8) lead frames in a side-by-side orientation at least one end of the insert housing member.

15. The insert of claim 1, wherein the capacitive elements are effective to compensate for noise introduced to the lead frames through connection with a plug.

16. A jack assembly comprising:

(a) a jack housing defining a plug-receiving space; and (b) an insert assembly positioned within the jack assembly, the insert assembly including: (i) an insert housing member; and (ii) a plurality of lead frames supported at least in part by said insert housing member;

wherein each of the lead frames includes a rear end portion and a front end portion;

wherein each of at least four of the plurality of lead frames includes a capacitive element in electrical communication with at least the front end portion;

wherein the four lead frames in electrical communication with capacitive elements are arranged in two pairs to define a first pair of capacitive element lead frames and a second pair of capacitive element lead frames; and wherein the first pair of capacitive element lead frames and the second pair of capacitive element lead frames are spaced apart by an angle of at least thirty degrees.

17. The assembly of claim 16, wherein each of the capacitive elements associated with each of the first pair of capacitive element lead frames and the second pair of capacitive element lead frames are spaced apart from each corresponding capacitive element of the pair by at least 0.0011 inches.

18. The assembly of claim 16, wherein each of the capacitive elements defines a substantially rectangular geometry.

19. The assembly of claim 16, wherein the capacitive elements associated with the first pair of capacitive element lead frames are electrically isolated from each other and the capacitive elements associated with the second pair of capacitive element lead frames are electrically isolated from each other.

20. The assembly of claim 16, wherein a first dielectric spacer is disposed between each of the capacitive elements associated with the first pair of capacitive element lead frames and a second dielectric spacer is disposed between each of the capacitive elements associated with the second pair of capacitive element lead frames.

21. The assembly of claim 16, wherein the capacitive elements are characterized by a member selected from the group consisting of metallic capacitive plates, metallic capacitive pads and combinations thereof.

22. The assembly of claim 16, wherein the capacitive elements are integrally formed with respect to each corresponding lead frame.

23. The assembly of claim 16, wherein the capacitive elements are coated with a dielectric coating material.

24. The assembly of claim 16, wherein the plurality of lead frames includes eight (8) lead frames in a side-by-side orientation exposed to the plug-receiving space.

25. The assembly of claim 24, wherein the eight lead frames define two central pairs, each of the leads of the two central pairs includes a capacitive element, and wherein the two central pairs are characterized as the first and second pair of capacitive element lead frames.

26. The assembly of claim 16, wherein: (i) the insert housing is adapted to receive a plug; (ii) the plurality of lead frames are adapted to electrically communicate with the plug; and (iii) the capacitive elements are adapted to compensate for crosstalk noise associated with electrical communication between the plug and the lead frames.

27. A method for accommodating plugs having differing contact layouts, comprising:

(a) providing a jack assembly that defines a plug-receiving space, the jack assembly supporting a plurality of lead frames accessible to the plug-receiving space, the plurality of lead frames including: (i) eight lead frames in side-by-side relation defining two central pairs of lead frames, wherein each lead frame defines a front portion and a rear portion; and (ii) at least one capacitive element positioned on each of the front portions of each of the lead frames associated with the central two pairs, wherein the two central pairs of lead frames are spaced apart by an angle of at least thirty degrees;

(b) inserting a plug into the plug-receiving space of the jack assembly, and (c) automatically compensating for noise generated through insertion of the plug into the plug-receiving space.

28. The method of claim 27, wherein each of the capacitive elements: (i) defines a substantially rectangular geometry; (ii) is electrically isolated from a capacitive element associated with the other corresponding lead frame of the pair of lead frames; and (iii) is characterized by a member selected from the group consisting of metallic capacitive plate, metallic capacitive pad and combinations thereof.

* * * * *